United States Patent [19]

Parish

[11] Patent Number: 4,631,873

[45] Date of Patent: Dec. 30, 1986

[54] INFLATABLE SHELTER

[75] Inventor: James M. Parish, Wadsworth, Ohio

[73] Assignee: The B.F. Goodrich Company, Akron, Ohio

[21] Appl. No.: 730,905

[22] Filed: May 6, 1985

[51] Int. Cl.[4] ..... E04B 1/345

[52] U.S. Cl. ..... 52/2; 135/103

[58] Field of Search ..... 135/103; 52/2

[56] References Cited

U.S. PATENT DOCUMENTS

| | | | |
|---|---|---|---|
| 2,028,060 | 1/1936 | Gilbert | 52/2 |
| 2,837,101 | 6/1958 | Bary | 52/2 |
| 2,854,014 | 9/1958 | Hasselquist | 52/2 |
| 3,999,333 | 12/1976 | Amarantos | 52/2 |

*Primary Examiner*—James L. Ridgill, Jr.

*Attorney, Agent, or Firm*—Joseph Januszkiewicz

[57] ABSTRACT

An inflatable shelter having a plurality of sections wherein each section has a series of inflatable arched tubes that are arranged parallel to each other and in successive tangential abutting contact. Adjacent tubes in each section are interconnected along their abutting surfaces. Each section has a cover that overlies such section and provides means for securing the sections together and to the adjoining ground against movement. End flaps are connected to the shelter to fully enclose such shelter.

12 Claims, 16 Drawing Figures

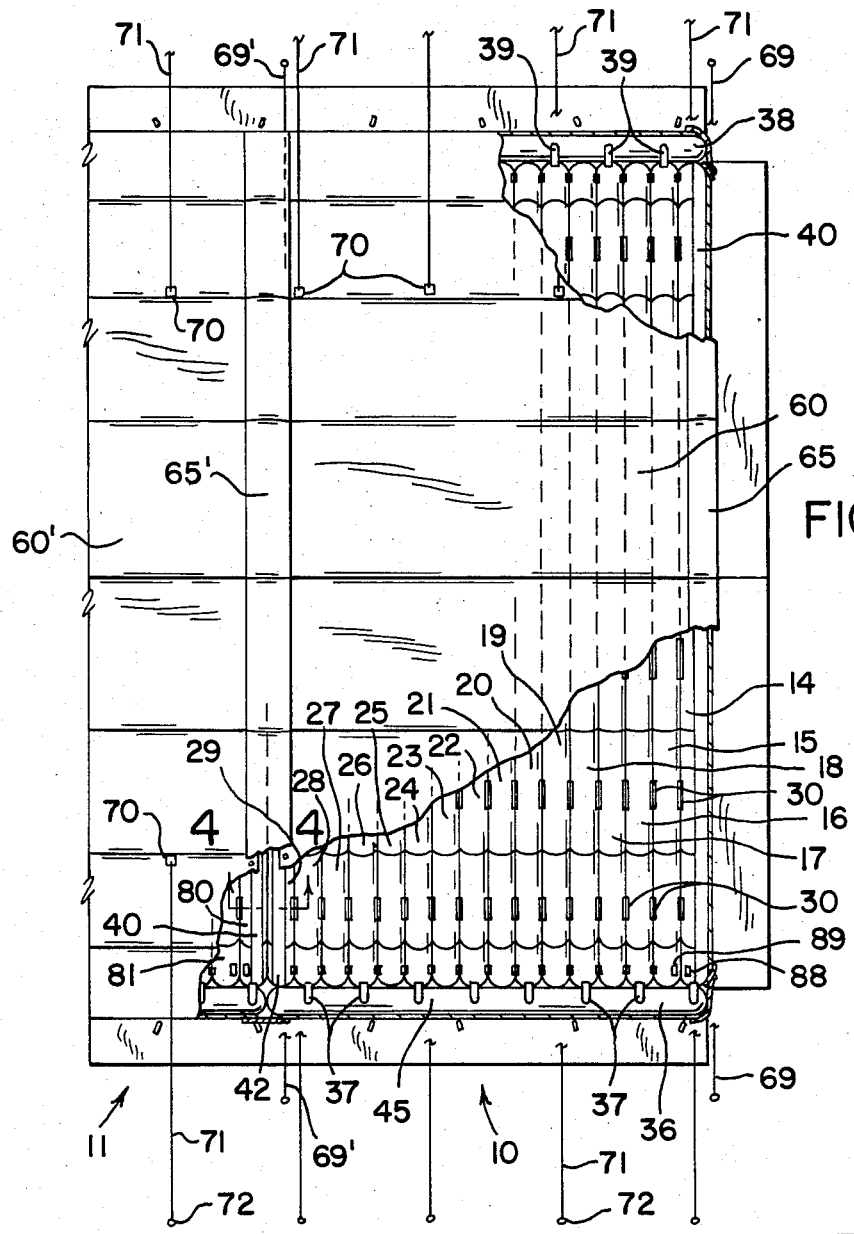
FIG. 3
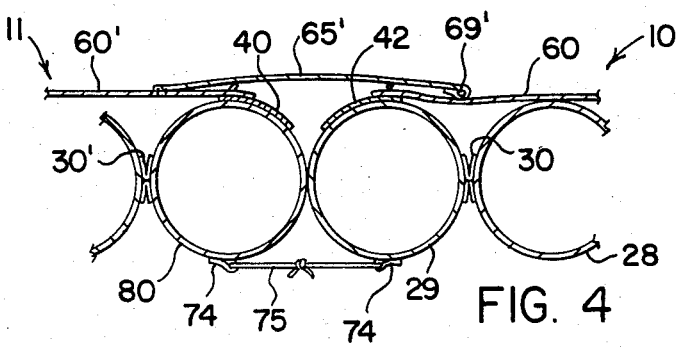
FIG. 4
FIG. 5
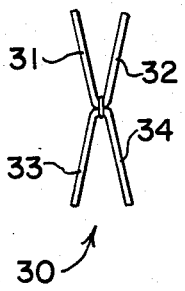

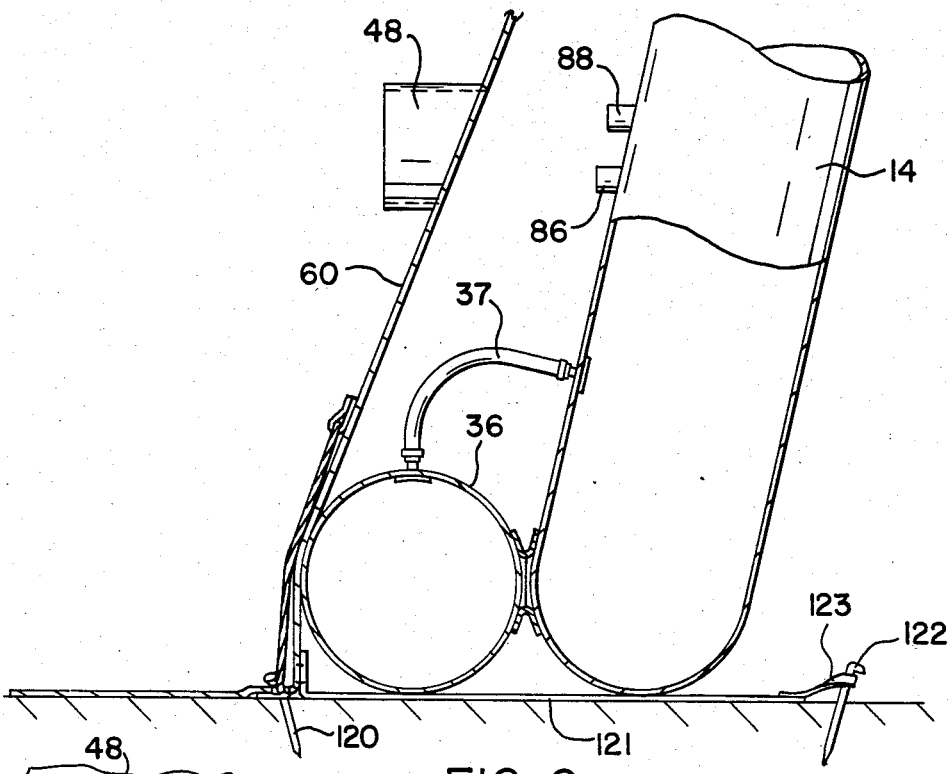
FIG. 6
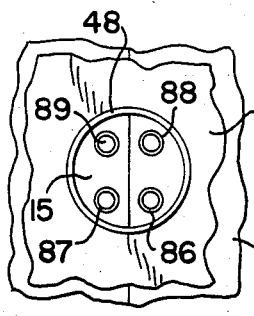
FIG. 7
FIG. 8
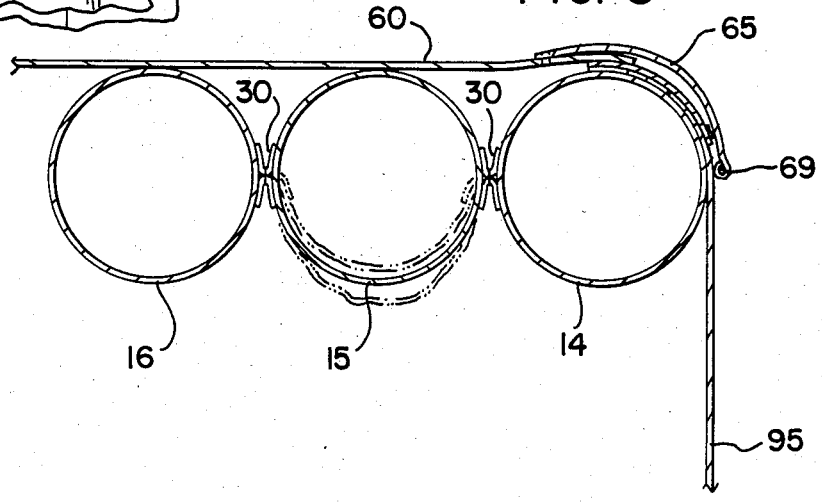

FIG. 9
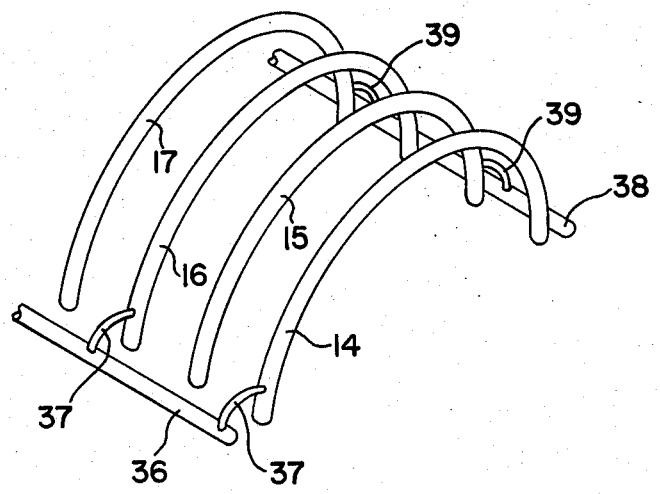
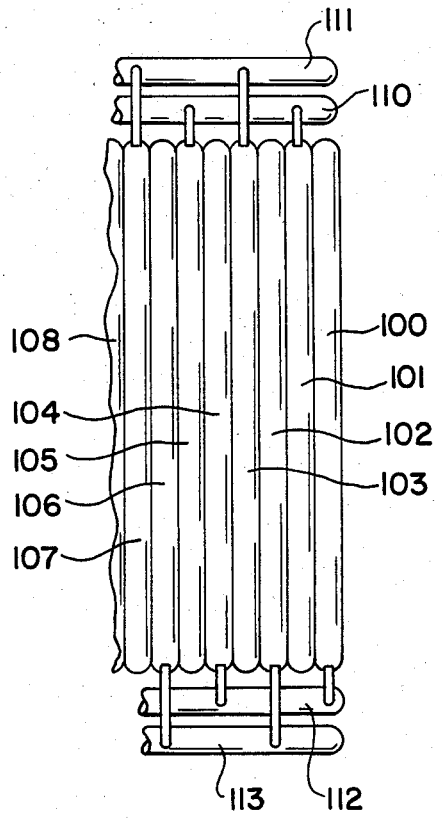
FIG. 10

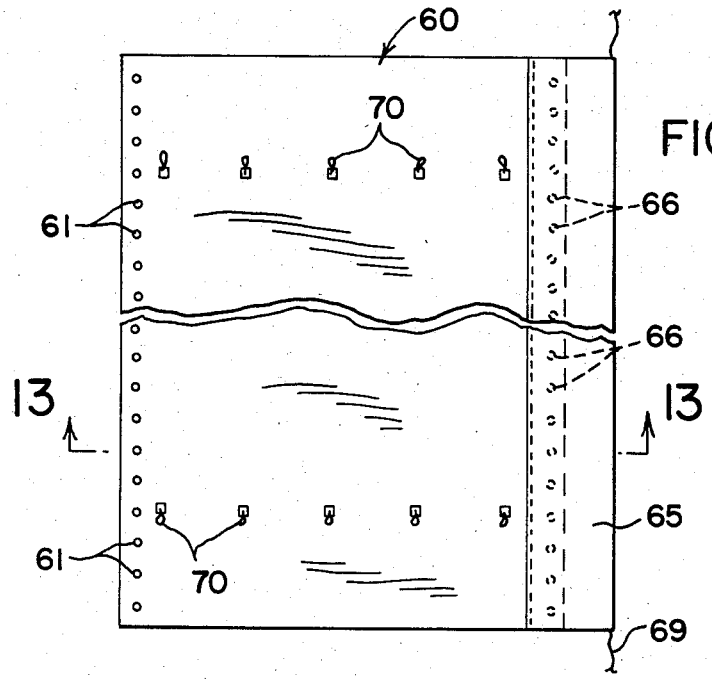
FIG. 11
FIG. 12
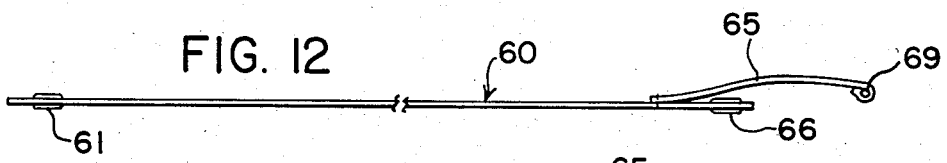
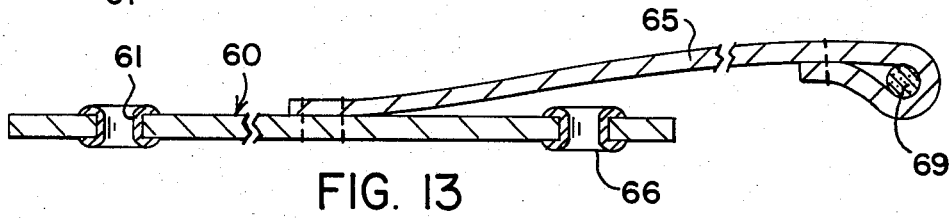
FIG. 13
FIG. 14
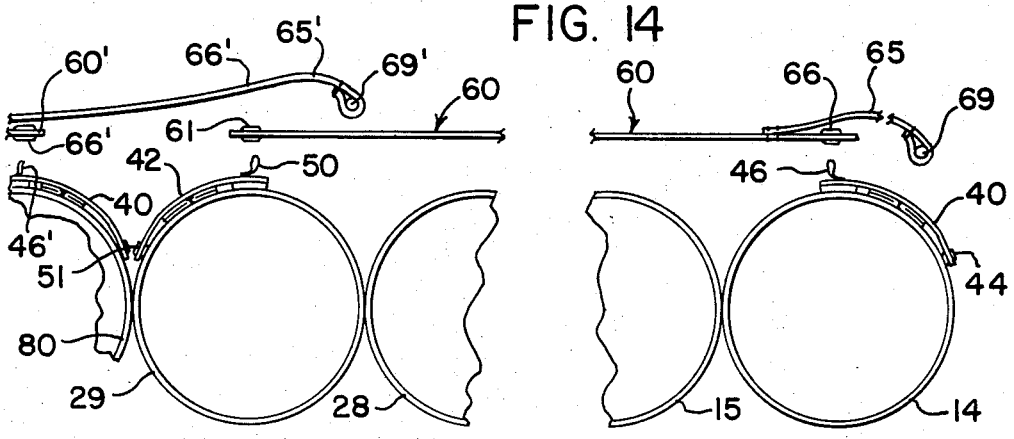

INFLATABLE SHELTER

BACKGROUND OF THE INVENTION

This invention relates to inflatable structures for use on a temporary basis or on a permanent basis.

The inflatable shelter of the present invention is formed of a plurality of modular sections wherein the number of sections used may be increased or decreased to make a complete shelter. Heretofore, inflatable buildings or shelters utilized a canopy of flexible impermeable material which was shaped so that it could be supported solely by internal air pressure. Such structures required a fully enclosed or encapsulated canopy to prevent any leakage of excessive air around its periphery. A variation on this structure was to use inflatable tubes in cooperation with cross braces or interconnecting panels along the floor to form a unitary structure. The present invention eliminates the need for ground level interconnecting panels while utilizing the concept of being able to increase or decrease the number of sections to enhance versatility.

SUMMARY OF THE INVENTION

The present invention contemplates an inflatable shelter that is composed of sections wherein each section is composed of a plurality of inflatable arched tubes. Such tubes are arranged in parallel abutting relationship with adjacent tubes in each section interconnected along a plurality of spaced abutting surfaces. A flexible cover is attached to each section and also provides the means for interconnecting the sections into an integral shelter. A plurality of manifold tubes communicate preselected alternate tubes to thereby insulate the structural integrity of the entire shelter. End flaps are provided for connection to the respective ends to fully enclose the shelter.

BRIEF DESCRIPTION OF THE DRAWINGS

FIG. 3 is a plan view of a portion of the inflatable shelter with a portion of the cover broken away to illustrate the arched tubes and manifold.

FIG. 4 is an enlarged cross sectional view of the arched tubes adjacent sections taken on line 4—4 of FIG. 3.

FIG. 5 is an enlarged cross sectional view of a doubled V-shaped tape used in connection adjacent arched tubes.

FIG. 6 is an enlarged cross sectional view of a portion of an arched tube with its manifold and cover taken on line 6—6 of FIG. 2.

FIG. 7 is a front elevational view of an access tube and the valves for one of the respective shelter sections.

FIG. 8 is a plan view of a corner portion of one of the shelter sections showing the cover and end panel attached to an arched tube.

FIG. 9 is a schematic illustration of the arched tubes connected to their respective manifolds.

FIG. 10 is a plan view of a modified form of the invention showing the arched tubes connected to manifolds.

FIG. 11 is a plan view of a section cover.

FIG. 12 is a side elevational view of a cover.

FIG. 13 is an enlarged cross sectional view of a cover taken on line 13—13 of FIG. 11 to show the elements thereof in greater detail.

FIG. 14 is a fragmentary cross sectional view of an inflatable tube section illustrating a cover ready to be attached thereto.

DETAILED DESCRIPTION

Figure 1:
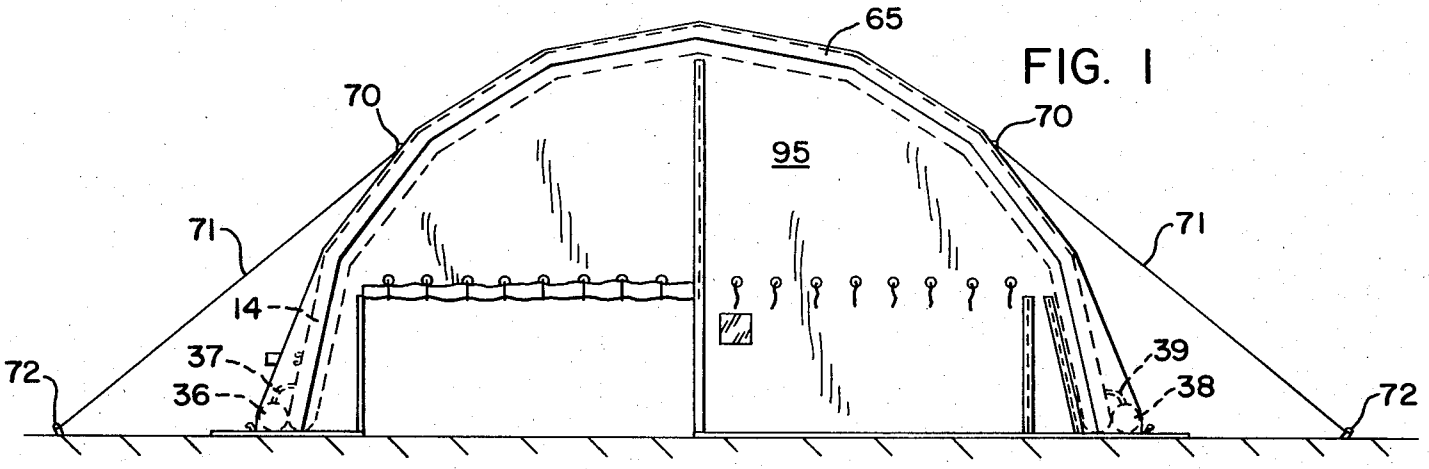
FIG. 1 is a front elevational view of an inflatable shelter.

Referring to the drawings wherein like reference numerals refer to like and corresponding parts throughout the several views, there is shown in FIG'S. 2 and 3 an inflatable shelter having tubular shelter sections 10, 11 and 12. All of the sections are alike and only one section 10 will be described in detail. Section 10 is composed of a plurality of arched inflatable tubes 14 through 29. Each of these inflatable tubes are individual curved or arched tubes circular in cross-section. Such arched tubes as illustrated in FIG'S. 1 and 2 can be a series of interconnected linear portions defining a series of arched tubes 14 through 29. The series of tubes 14 through 29 are arranged and held in tangential abutting relationship by a plurality of double V-shaped tabs 30 (FIG'S. 4 and 5) that are cemented to adjacent tubes along linear spaced positions. As shown in FIG. 5, the tab 30 has an upper V portion with legs 31 and 32 and a lower V portion with legs 33 and 34. The legs 31 and 33 of the tab 30 are cemented to one tube such as tube 15 and legs 32 and 34 of the tab 30 are cemented to an adjacent abutting tube such as tube 14. Such interconnecting of adjacent tubes is shown in FIG. 4. As seen in FIG'S. 2 and 3, the linear spaced contacts between tabs 30 maintains adjacent tubes in firm abutting contact. Alternate tubes 14, 16, 18, 20, 22, 24, 26 and 28 are connected at their lowermost portions to a manifold tube 36 via conduits 37 while alternate tubes 15, 17, 19, 21, 23, 25, 27 and 29 are connected at their lowermost portions to a manifold tube 38 via conduit 39.

Figure 15:
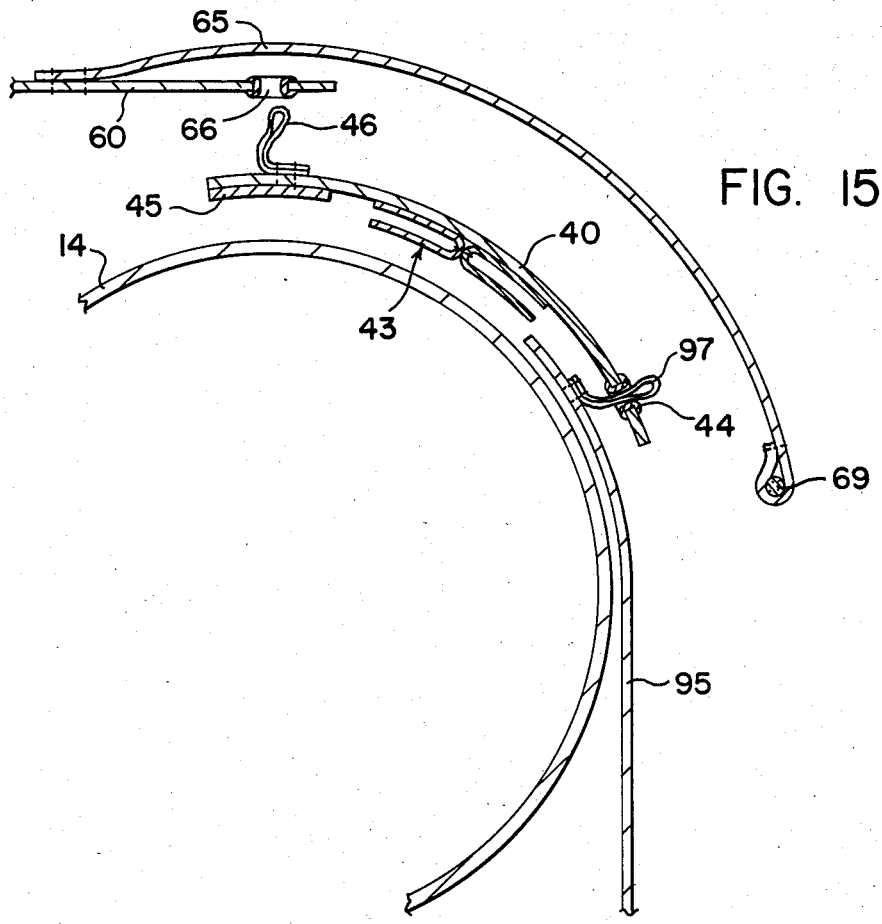
FIG. 15 is a cross sectional view of the end tube of a shelter section showing a tape about to be attached along with a portion of the cover and an end panel about to be attached.
Figure 16:
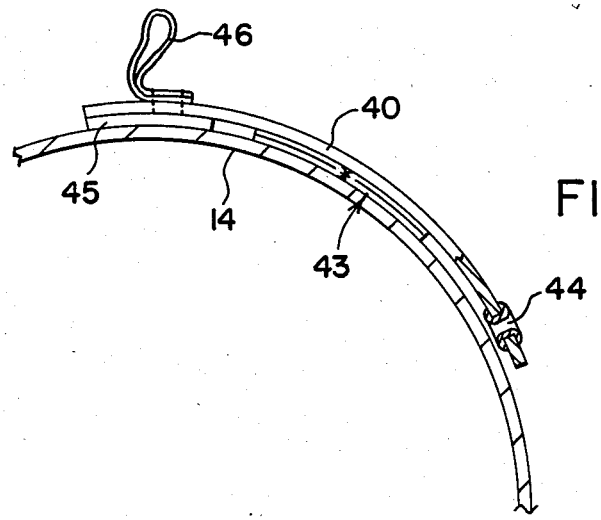
FIG. 16 is a cross sectional view of a portion of a tube showing a tape attached thereto.

End tubes 14 and 29 of section 10 (FIG. 14) have grommet lacing tapes 40 and 42 cemented respectively thereto, wherein such tapes extend along the full length thereof. Tape 40 has a plurality of loops 46 suitably attached along one side edge and a plurality of grommets 44 along the other running side edge. As seen in FIG. 15, the tape 40 is cemented to tube 14 along the center line. A suitable V-shaped strip 43 and reinforcing strips 45 are cemented to tube 14 and tape 40 to provide strength and eliminate any peeling between the tape 40 and the tube 14. The loops 46 are elongated loops of flexible textile material and are of sufficient length to permit its passing through an adjacent grommet for connecting sections or covers in a manner to be described. Tape 42 (FIG. 14) cemented to tube 29 is similar to tape 40 and has flexible loop 50 and a grommet 51. As in tape 40, tape 42 has V-shaped strips and reinforcing strips to provide sufficient strength to prevent peeling. Tape 42 is essentially cemented to tube 29 along the center line.

A cylindrically shaped access tube 48 to be described is suitably attached to the cover and allows access to suitable inlet fittings and relief valves installed on tubes 14 and 15 to provide means for inflating and deflating tubes 14 and 15 as well as the other tubes 16 through 29 via their connection to the manifold tubes 36 and 38.

While the tubes in section 10 are deflated, a cover 60 (FIG. 10) of water resistant material is placed over the section 10. Both ends of the cover 60 (FIG'S. 11 and 13) have a plurality of grommets 61 and 66 respectively located closely adjacent the edges thereof. One end of the cover 60 has a water resistant strip or flat 65 suitably connected to the cover 60, which as shown in FIG. 12 overlies the plurality of grommets 66 that lie along one edge of such cover 60. The very edge of flap 65 is turned under and secured to form a loop through which a draw rope 69 is threaded.

To secure the cover to the section 10, the loops 50 on tube 29 are threaded through the grommets 61 on cover 60 and are either individually secured or are speed laced up along the entire one side end of cover 60. Speed lacing is achieved as viewed in FIG. 11 wherein the loop 50 (from tube 29) at the uppermost portion of the drawing is looped over the adjacent loop 50 and so forth until the loop 50 at the bottom portion of the drawing (FIG. 11) is secured which in turn can be knotted to prevent its being pulled through its accompanying grommet 61. The other end of the cover 60 is then secured to the tube 14 at the other end of the section by passing loop 46 through the adjacent grommets 66 on the cover 60 and thence securing such loops 46 to prevent their pulling out of the grommets on the tube 14. The flap 65 overlies the section 10 to permit a weather tight joint when an additional section is abutted against section 10. The cover additionally has a plurality of spaced loop patches 70 (FIG'S. 1, 3 and 11) along the respective sides which receive a rope 71 whose one end is tied thereto. The other end of rope 71 has a loop which provides a means for securing such end to a stake 72 that is driven into the ground. The respective ends of rope 69 are then secured to suitable stakes in the ground and thus flap 65 acts as a rain flap that is also cooperative with an end panel that overlies the front to provide a means for preventing rain from coming into the sheltered portion of section 10.

The next section 11 is identical to section 10, and is connected to section 10 at their abutting tubes by securing a plurality of loop patches 74 (FIG. 4) to the underside of adjoining tubes and thence opposite adjacent loops are interconnected by extending a rope 75 therethrough and tie the ends together (FIG. 4). As in shelter section 10, the tubes in section 11 are abuttingly connected together at linear spaced contacts along the arch of the tubes. Section 11 has a pair of manifold tubes on both sides thereof similar to section 10, with such manifolds connected to alternate tubes. Section 11 receives a separate cover 60′ and is connected to the respective end tubes in a similar manner as discussed above for fastening cover 60 to tubes 29 and 14. As seen in FIG'S. 2, 12 and 13, the cover 60′ is secured to tube 83 via loops similar to loops 50 on tube 29 extending through grommets 61 on cover 60′. The other end of cover 60′ is secured to tube 80 (FIG. 14) by passing loop 46′ through grommet 66′ on cover 60′. Such grommets on cover 60′ are identical to grommets 61 on cover 60. End tube 80 of section 11 that adjoins tube 29 discloses flap 65′ as overlying the juncture of tubes 80 and 29 such that a rope 69′ that is threaded through the looped end of flap 65′ can be drawn tight to secure the cover to the tubes. The respective ends of rope 69′ are then secured to stakes driven into the ground.

The next section 12 is identical to section 10 and 11 and is connected to section 11 at their abutting tubes by the use of loop patches as depicted by FIG. 6. That is, loop patches are secured to the underside portions of adjacent or adjoining tubes of sections 11 and 12, which loop patches are spaced along the length of the tubes, then a rope is used to interconnect adjacent loops as depicted by FIG. 4 which interconnects sections 10 and 11. As in section 10, the tubes in section 12 are abuttingly connected together at linear spaced contacts along the arch of the tubes. Section 12 has a pair of manifold tubes on both sides thereof similar to section 10 with such manifolds connected to alternate tubes as in the other sections 10 and 11. Section 12 receives a separate cover and is connected to the respective end tubes in the same manner as discussed above for fastening cover 60 to tubes 29 and 14. End tube 83 of section 11 that adjoins end tube 82 in section 12 is covered by a flap from the cover that overlies section 12 such that when the rope that is threaded through the looped end of the flap (of the cover that overlies section 12) as rope 69 in section 10 is drawn tight to securely contact the shelter. The ends of such rope are then secured to stakes driven into the ground and thus firmly anchors the cover and section 12 as well as one end portion of section 11.

Figure 2:
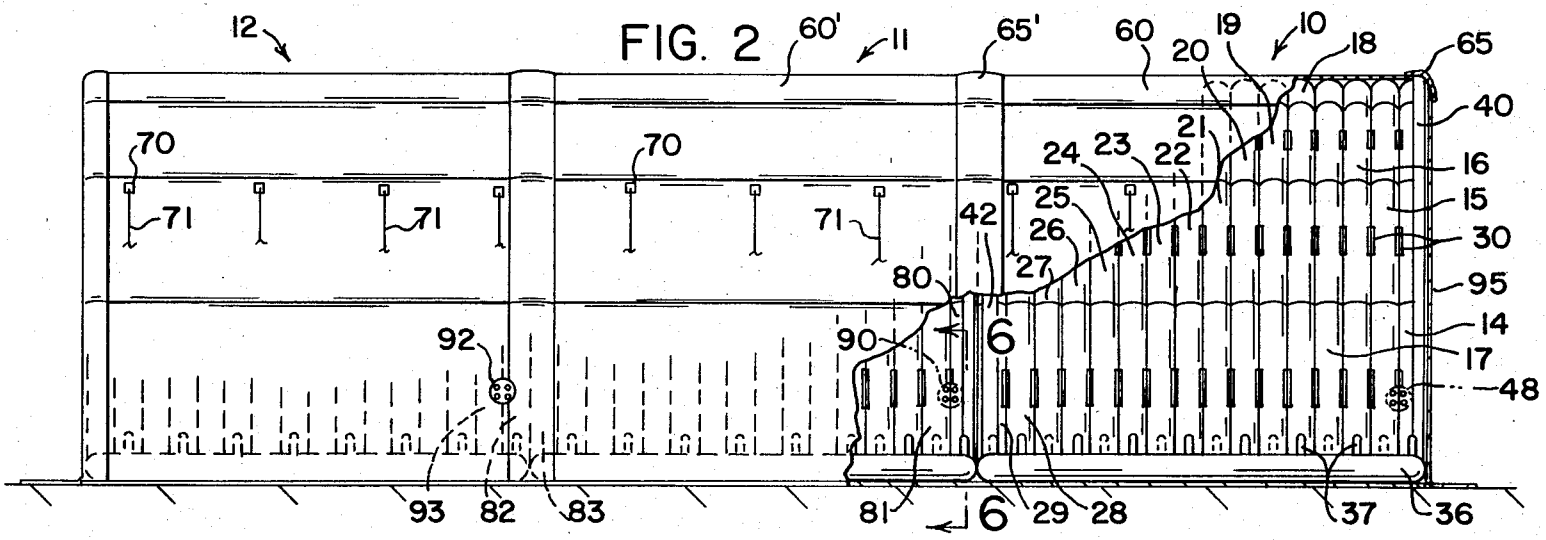
FIG. 2 is a side elevational view of the inflatable shelter with a portion thereof shown without the cover to illustrate the arched tubes in one of the shelter's sections.

Access tube 48 (FIG. 2) located between tubes 14 and 15 on cover 60 provides access to a pair of inlet fittings 86, 87 and a pair of relief valves 88 and 89. Inlet fitting 86 and relief valve 88 is mounted directly on tube 14, while inlet fitting 87 and relief valve 89 is mounted directly on tube 15. Inlet fitting 86 communicates directly to tube 14 for inflating such tube 14 and further provides pressurized air for the manifold 45 which in turn can inflate the alternate tubes 16, 18, 20, 22, 24, 26 and 28. A portable compressor or other suitable means may be provided for connection to the inlet valves 86 and 87. Inlet valve 87 communicates directly to tube 15 for inflating such tube 15 and further provides pressurized air for the manifold 38 which in turn can inflate the alternate tubes 17, 19, 21, 23, 25, 27 and 29. A separate access tube 90 (FIG. 2) is mounted on the cover 60′ to provide access to suitable inlet fittings and relief valves that are connected to adjacent tubes 80 and 81 while another access tube 92 is mounted on the cover that overlies section 12 to provide access to suitable inlet fittings and relief valves that are connected to adjacent tubes 82 and 93.

An end panel 95 (FIG'S. 1 and 15) is suitably secured to the section 10. Panel 95 has a plurality of loops 97 suitably sewn thereon along the upper outer periphery as viewed in FIG. 1, which loops 97 are suitably connected to the grommets 44 on the reinforcing tape 40 situated on tube 14. As seen in FIG. 15, once the loops 97 are secured to the respective grommets 44, the flap 65 of cover 60 overlies the grommet and loop connections to shelter such connection from the weather. Suitable access flaps may be cut into the end panel 95 to provide access into and out of the shelter. A suitable end panel with a flap may be secured in a similar manner to the end of section 12 to provide a fully enclosed shelter. The number of sections connected together may be varied to provide an expansion of the shelter as desired. In addition, the number of manifold may be varied to provide greater reliability to the shelter from malfunctioning in case one tube is damaged. As seen in FIG. 9, alternate tubes as described above are connected to alternate manifolds whereas FIG. 10 discloses a modification of the manifold system whereas every fourth tube is connected to the same manifold. Herein assuming as series of inflatable arched tubes 100 through 108 only shown with manifold tubes 110, 111, 112 and 113. Manifold 110 is connected to arched tubes 101 and 105 and every other 4th tube in such section, while manifold 111 is connected to arched tubes 103 and 107 and every other 4th tube. In the same manner manifold tube 112 is connected to arched tubes 100 and 104 while manifold tube 113 is connected to arched tubes 102 and 106.

The respective covers for the different shelter sections may be anchored to the ground by providing longitudinal loop patches along the peripheral side edges of the covers and thence securing the section to the ground with ropes extending from the loops to stakes 120 as shown in FIG. 6. A further variation of anchoring the covers is to adhere a cover flat 121 (FIG. 6) to the respective side edges and extend such flap 121 under the manifold tubes and the lower portion of the tubes of the shelter sections and stake the respective ends thereof via stakes 122 through loop patches 123 that are cemented along the peripheral edges of such flaps 121.

To assemble the shelter as described above, it is only necessary to level the ground or clear a substantially level area. Thereafter, the respective uninflated sections 10, 11 and 12 are laid flat on the ground with their covers laid over their respective sections and connected thereto as described in detail above. The respective covers are then interconnected such that the respective flaps cover the juncture of the sections. The respective side ropes 71 are tied loosely to the stakes and thence the inlet valves via their respective access tubes are connected to a suitable source of pressurized fluid and the respective tubes in sections 10, 11 and 12 are inflated to the position shown in FIG'S. 1 and 2. The tension in the side ropes 71 are then adjusted as the tension in the ropes 69 and 69' of the respective covers 60 and 61 as well as the unnumbered rope in the flat used to cover section 12.

Various modifications are contemplated and may obviously be resorted to by those skilled in the art without departing from the described invention, as hereinafter defined by the appended claims.

I claim:

1. An inflatable shelter having at least two separate sections, each section having a series of inflatable arched tubes arranged transversely of said section, adjacent ones of said tubes in each section are interconnected, means interconnecting adjacent sections each of said sections having a roof cover sheet overlying the tubes in their respective sections, each of said covers has, means for securing the section it overlies to an adjacent section, and anchoring means connected to said cover sheets for anchoring said cover sheets and sections to the ground supporting said inflatable shelter.

2. An inflatable shelter as set forth in claim 1 wherein each section has manifold means connected to said tubes to provide communication between all of said tubes in said section.

3. An inflatable shelter as set forth in claim 1 wherein alternate tubes in each of said sections are connected to separate manifold tubes to provide structural integrity of said sections.

4. An inflatable shelter as set forth in claim 1 wherein said tubes in each of said sections are connected to a plurality of manifold tubes.

5. An inflatable shelter as set forth in claim 3 wherein said adjacent ones of said tubes in each section are interconnected along longitudinally spaced abutting portions by tapes that are cemented to said adjacent tubes.

6. An inflatable shelter as set forth in claim 5 wherein each of said cover sheets has a flap that overlies the juncture of adjacent sections to shelter said juncture.

7. An inflatable shelter having a plurality of sections, each section having a series of inflatable arched tubes arranged parallel to each other and in successive tangential abutting contact one to the other throughout the length of said tubes, each tube having a pair of spaced ends, the adjacent tubes in each section are interconnected to provide integrity to each section, each section has a flexible cover overlying such section and secured thereto, adjacent sections are interconnected by said flexible covers, and anchoring means secured to said covers anchor said covers and said sections against movement.

8. An inflatable shelter as set forth in claim 7 wherein each of said sections and their respective tubes are connected to separate manifold tube means.

9. An inflatable shelter as set forth in claim 7 wherein each of said sections has a pair of manifold tubes lying closely adjacent said ends of said tubes in said sections, one set of alternate tubes in each section are connected to one of said pair of manifold tubes that are adjacent thereto, the remaining set of alternate tubes in each section are connected to the other one of said pair of manifold tubes that are adjacent thereto.

10. An inflatable shelter as set forth in claim 9 wherein each of said sections have inlet valves and relief valves connected to certain ones of said tubes to provide means for selectively inflating and deflating said sections.

11. An inflatable shelter as set forth in claim 10 wherein said anchoring means includes loop patches secured along spaced portions of said cover, and tie means extend from said loop patches to stakes driven into ground adjoining said shelter.

12. An inflatable shelter as set forth in claim 10 wherein each of said covers has a flap on either side that is adjacent said ends of said tubes, and all of said flaps extend over said tube ends towards the interior of said shelter, said flaps have longitudinally spaced loops along the periphery thereof, and stakes extend through said loops to securely fasten said shelter in place.

* * * * *